United States Patent [19]

Nordmann et al.

[11] Patent Number: 5,063,824

[45] Date of Patent: Nov. 12, 1991

[54] FLUID PROPELLANT INJECTION DEVICE FOR A GUN AND A FLUID PROPELLANT GUN ITSELF

[75] Inventors: Adolf Nordmann, Erkrath; Erich Zielinski, Haan, both of Fed. Rep. of Germany

[73] Assignee: Rheinmetall GmbH, Düsseldorf, Fed. Rep. of Germany

[21] Appl. No.: 948,092

[22] Filed: Dec. 24, 1986

[30] Foreign Application Priority Data

Dec. 28, 1985 [DE] Fed. Rep. of Germany ..... 3546235

[51] Int. Cl.[5] ..... F41A 1/04

[52] U.S. Cl. ..... 89/7; 89/1.1

[58] Field of Search ..... 89/7, 8, 1.1

[56] References Cited

U.S. PATENT DOCUMENTS

| | | | |
|---|---|---|---|
| 3,763,739 | 10/1973 | Tassie | 89/7 |
| 4,023,463 | 5/1977 | Tassie | 89/7 |
| 4,337,685 | 7/1982 | Munding et al. | 89/7 |
| 4,341,147 | 7/1982 | Mayer | 89/7 |
| 4,586,422 | 5/1986 | Magoon | 89/7 |
| 4,603,615 | 8/1986 | Ashley | 89/7 |

FOREIGN PATENT DOCUMENTS 1728077 2/1978 Fed. Rep. of Germany .

*Primary Examiner*—David H. Brown

*Attorney, Agent, or Firm*—Spencer & Frank

[57] ABSTRACT

An injection device for fluid propellants for a fluid propellant gun includes at least one pump chamber to accommodate a propellant, a pump piston movable therein and a device for the measured opening and closing of apertures in an injector surface disposed at least partially around a combustion chamber of the gun and approximately radially to the direction of ejection of a projectile from the gun. The device for the measured opening and closing of the apertures in the injector surface is composed of a slide provided with passage openings, the slide being relatively movable with respect to the injector surface and being displaceable by a pressure generating device.

33 Claims, 3 Drawing Sheets

FLUID PROPELLANT INJECTION DEVICE FOR A GUN AND A FLUID PROPELLANT GUN ITSELF

RELATED APPLICATIONS

This application is related to U.S. application Ser. No. 06/948,096 filing concurrently herewith by the same inventors, the disclosure of which is incorporated by reference.

BACKGROUND OF THE INVENTION

The present invention relates to an injection device for fluid propellants for guns, with the injection device including a pump chamber to accommodate the propellant, a pump piston axially movable therein and a means for the measured opening and closing of apertures in an injector surface disposed at least partially around a combustion chamber approximately radially to the direction of projectile ejection, and to a fluid propellant gun having at least one of these injection devices.

Such an arrangement is disclosed in German Patent No. 2,226,175 and corresponding U.S. Pat. No. 3,763,739 to Douglas P. Tassie which relates to a valve for controlling the propellant supply into the combustion chamber of an automatic weapon. The weapon here includes a weapon housing in which a barrel having a bore is rigidly fixed. The rear end of the bore is subdivided into chambers so as to accommodate a projectile and to form a combustion chamber whose end opposite the projectile is sealed by a breechblock. The circumferential face of the combustion chamber between the projectile chamber and the breechblock is partially designed as an injector surface. The term "injector surface" is to be understood herein to mean a surface provided with a plurality of apertures (injection nozzles) through which the fluid propellant is injected into a combustion chamber.

A control slide makes it possible, depending on its position, to release the flow cross section of the inlet openings of the injector surface by appropriate parallel displacement.

German Patent No. 1,728,077 discloses a differential pressure piston combustion chamber system for generating propellant gases, particularly for firearms. The propellant and the oxygen or, more precisely, the oxygen carrier, are injected into the combustion chamber axially with respect to the direction of projectile ejection by way of corresponding intake conduits and chambers. The partial quantities of the two propellant components injected into the combustion chamber react hypergolically. With initiation of the combustion process, the pressure in the combustion chamber increases and drives the differential piston back, thus causing further injection of a further quantity of the two propellant components stored in the dosaging chambers.

German Offenlegungsschrift [laid-open patent application] 2,725,925 and corresponding U.S. Pat. No. 4,023,463 to Douglas P. Tassie disclose a pumping device for a gun operated with a liquid propellant. The propellant introduced into a pump chamber is injected axially into the combustion chamber by way of channels disposed in the head section of a pump piston. A displaceable sleeve arranged coaxially with the pump piston has an enlarged head which serves to control the flow and quantity of the propellant.

All of the above prior art arrangements are relatively complicated in their structural design and in the association of the individual components as well as their sequences of movement. A particular drawback, however, is that the supply of propellant can be dosaged only in relatively large quantity steps. Moreover, due to the structural design of arrangements which provide for radial propellant input into the combustion chamber as in German Patent No. 2,226,175 and U.S. Pat. No. 3,763,739, the propellant is supplied only at one end or moves gradually across the cross section of the combustion chamber, so that pressure generation is different throughout the combustion chamber and makes reproducibility of the internal ballistics difficult.

Different guns require different propellant supplies and control possibilities for propellant injection and these can also not be provided by the prior art arrangements. The case is similar with respect to variability of the projectile ejection velocity and temperature influences, for example, as a result of so-called "warming up" of the gun barrel.

Additionally, in some prior art arrangements the introduction of the projectiles is relatively complicated as disclosed, for example, in German Patent No. 1,728,077.

In an arrangement disclosed, for example, in German Patent No. 2,226,175 and corresponding U.S. Pat. No. 3,763,739 there exists an additional drawback in that damping of components sometimes charged with high velocities is possible only conditionally, which sometimes brings about considerable and undesirable excess material stresses, and interferes with the resistance to malfunctions of a gun, particularly during continuous operation.

SUMMARY OF THE INVENTION

It is an object of the invention to eliminate the above-described drawbacks as much as possible. In particular, an injection device is to be made available which is simple in configuration, reliable in operation and easily manipulated. Additionally, this device is to be accessible to monoergolic and diergolic, hypergolic propellants and to permit easy insertion of the projectiles.

The above and other objects of the invention are accomplished in the context of an injection device for fluid propellants for a gun as first described above, wherein the means for providing measured open and closing of the apertures in the injector surface include a slide which is relatively movable with respect to, and preferably parallel to, the injector surface and which is provided with passage openings for controllably communicating with the apertures in the injector surface, with the slide being directly or indirectly displaceble by a pressure generating means which may include the propellant, a separate priming charge, or the pump piston.

The present invention is based on the realization that optimized propellant injection and thus combustion can be realized by a change in the structural design and association of individual components of the injection device while simultaneously permitting quantitative control of the combustion process.

By configuring the slide with passage openings for the propellant, it becomes possible, on the one hand, to completely seal the combustion chamber and its peripheral injection surface against the pump chamber containing the propellant supply, in that, for example, a slide disposed therebetween (i.e. on the injector surface) is brought into contact with the injector surface in such a way that the surfaces between the openings in the slide cover the apertures in the injector surface. Conversely, a corresponding axial or rotary displacement of the slide brings the slide openings into congruence with the apertures in the injector surface so that the propellant is able to flow from the pump chamber through both the openings in the slide and the injector surface for injection into the combustion chamber.

With respect to the fastest possible, sudden opening movement of the slide, it is then of advantage if the slide is displaced in the described and desired manner not by means of its own mechanical displacement member, but indirectly or directly by means of a pressure generated by a separate priming charge, the propellant and/or the pump piston. This idea of the invention permits various structural embodiments.

An advantageous embodiment of the invention provides that slide, injector surface and/or pump piston are configured along their longitudinal extent, at least in partial sections of their corresponding surfaces, with sloped faces which form cones. For example, in one embodiment, in which the slide and the pump piston are configured as mutually coaxial components, the sloped faces may be arranged along the longitudinal extent of the components such that, in one position, an annular gap is formed between the two components which constitutes the pump chamber for the propellant and, in another position, after relative displacement of the components with respect to one another, both are brought into sealing contact while pressing out the propellant, whereupon, due to the annular gap becoming smaller during the displacement and the concomitant constriction of the propellant intake toward the injection nozzles, the relative velocity of the components with respect to one another is damped when the pump piston approaches.

However, this configuration also has other advantages. One advantageous feature of the invention provides that a pressure chamber is disposed at one end of the pump piston, with such pressure chamber preferably being in communication with the combustion chamber by way of a connecting line for conducting a gas. If then, for example, a priming charge is fired in the combustion chamber, gas pressure develops in the combustion chamber in a very short time and presses the pump piston away. This indirectly causes the propellant in the pump chamber to exert pressure on the slide, which before ignition of the priming charge was firmly sealed against the injector surface, so that the slide is released from its areal contact.

If pump piston and slide are designed as rotationally symmetrical components which are guided to be rotatable with respect to one another on curved grooves and curve rollers disposed above their corresponding surfaces, as provided by a further advantageous feature of the invention, the slide will simultaneously be rotationally displaced. With corresponding dimensions of the curved groove and curve rollers, the displacement path can be set such that thereafter the passage openings of the rotary slide are flush with those in the injector surface and thus it becomes possible to uniformly, and thus optimally, inject the propellant through the injector surface.

In this connection, it is a particular advantage that it is possible, almost without any time delay and in uniform distribution over the injector surface, to expose all apertures and simultaneously employ a high injection pressure. The injection pressure is here influenced in particular by the velocity of the pump piston and by the size of the injection nozzles in the injector surface.

Preferably, the corresponding parts of the injector surface and of the slide, respectively, are provided with oppositely oriented sloped faces so that, if the slide is returned after the propellant has been injected, the slide can actually be pressed onto the corresponding slope of the injector surface, with the return of the slide preferably occurring by way of the above-described curve rollers in the curved groove of the pump piston.

To assure secure guidance of the rotary slide relative to the pump piston, an advantageous feature of the invention provides that the pump piston is secured against rotation by way of a second groove and a second curve roller.

While one embodiment of the invention provides two or more pump chambers which are arranged around the charge or combustion chamber, the invention also includes an embodiment which has an annular pump chamber surrounding the combustion chamber.

In the one embodiment, injector surfaces are provided only above the sections of the combustion chamber which are associated with the respective pump chambers, while in the other embodiment, which has an annular pump chamber, a preferably cylindrical injector surface surrounds the combustion chamber. In that case, the slide and the pump piston are also preferably provided in the form of a sleeve and an annular piston, respectively, while in the embodiment having a plurality of pump chambers arranged around the combustion chamber, a cylindrical slide sleeve may be provided around each pump piston. In that case, each slide sleeve is guided on a correspondingly curved outer face of the injector surface.

According to one structural variation a compressed biasing device, such as an annular spring disposed on an axial roller bearing, is positioned at the rear end of the slide when seen in the direction of movement of the pump piston (arrow A in FIG. 1).

This spring arrangement then also takes care that, after abutment of the pump piston against the rotary slide, when the gas pressure drops, the rotary slide is reliably returned to the injector surface in the manner described, and the spring force, translated by way of the cone, once the slide has returned to its starting position, provides a secure seal between the slide and the injector surface.

In an embodiment in which the control slide forms the delimiting wall of the combustion chamber and the injector surface is disposed between the control slide and the pump piston, the invention also proposes, as an advantageous feature, a corresponding spring bearing so that, after a drop in pressure, the slide can reliably be returned to its contact sealing position with respect to the injector surface.

Independently of the configuration of the device according to the invention with an annular pump chamber around the combustion chamber or with separate pump chambers, the configuration according to the invention provides the possibility of very finely dosaging the addition of propellant.

In this connection, a further feature of the invention provides that an abutment for a pull or push rod is attached to one end of the pump piston so as to provide, by way of an appropriate drive, adjustable guidance of the pump piston, thus setting the size of the propellant supply chamber as well. At the same time, this device makes it possible, for example, when firing ceases, to pull out and press forward the pump piston and thus empty the pump chamber through an appropriately connected valve.

In order to be able to prevent twisting displacement of the slide during the corresponding inevitable movement of the pump piston in the embodiment employing curve rollers and a curved groove to rotatably guide the slide, an unlatching cylinder is preferably provided which lifts a corresponding curve roller from a curved groove in the pump piston surface, as long as the pump piston is being positively guided.

With the device according to the present invention, monoergolic as well as diergolic hypergolic propellants can be used. For example, in the embodiment employing a plurality of separate pump chambers around the charge or combustion chamber, different propellants can be supplied to the different pump chambers, with the propellants meeting one another and reacting only after being injected through the injector surface into the combustion chamber.

As a whole, the device according to the present invention and its regenerative fluid drive provides improved and particularly controllable internal ballistics due to the structural configuration of the device, thus permitting its use in tank and artillery guns of different calibers. In view of the fact that the injector surface can be dimensioned at will, controlled combustion is realized. The structural association of the components makes additional recoil brake elements superfluous. Rather, the propellant itself takes over this task and, as an additional advantage, can be injected into the combustion chamber at a high injection pressure.

Due to the configuration according to the invention, the priming charge may also be made available in a different manner. On the one hand, it is possible to provide it as an additional charge in the projectile, preferably in the annular piston arrangement. Or, a partial quantity of the propellant may be injected by means of extraneous energy. Finally, it is possible to keep available a certain quantity of propellant in an appropriate antechamber.

A fluid propellant gun requires a gastight breechblock which is tight not only during firing. If there are leaks in the pump chamber, the escaping propellant is gasified in the hot gun barrel and must then not act on the crew.

In this connection, an advantageous feature of the invention provides in a particularly simple manner to additionally seal the components against one another by means of appropriate sealing rings. This is particularly easy in connection with rotationally symmetrical components, which is a further advantage of the present invention.

Indirectly, the arrangement according to the invention provides the advantage that it is particularly easy to supply the gun with new projectiles.

Due to the provision of radial injection and the appropriate arrangement of the components of the injection device, the area in the extension of the gun barrel can be extended rearwardly, behind the combustion chamber, so as to accommodate the projectile, with new projectiles being supplied through the gun barrel section then formed. This can be done in a particularly simple manner by means of automatic control. A relatively simple breechblock, which is preferably pivotally movable perpendicularly to the direction of projectile ejection, reliably seals the combustion chamber during firing. Preferably, a mushroom-type breechblock is provided, as known, for example, for artillery guns.

BRIEF DESCRIPTION OF THE DRAWINGS

The invention will now be described in greater detail with reference to two embodiments illustrated in the drawings, wherein.

DESCRIPTION OF THE PREFERRED EMBODIMENTS

Figure 1:
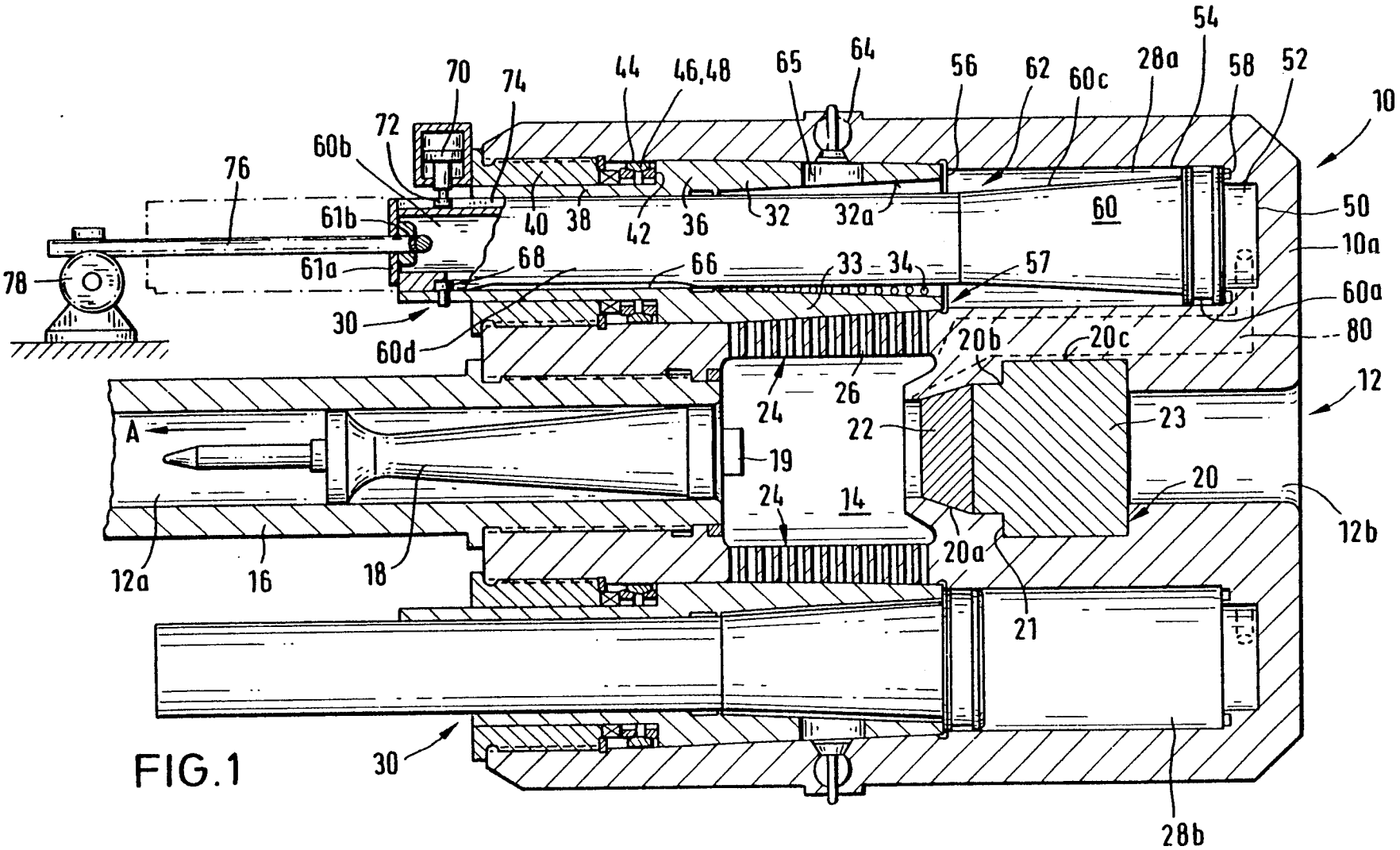
FIG. 1 is a longitudinal sectional view of a fluid propellant gu employing an injection device according to one embodiment of the present invention wherein two pump chambers are disposed at opposite sides of a combustion chamber of the are disposed at opposite gun.
Figure 2:
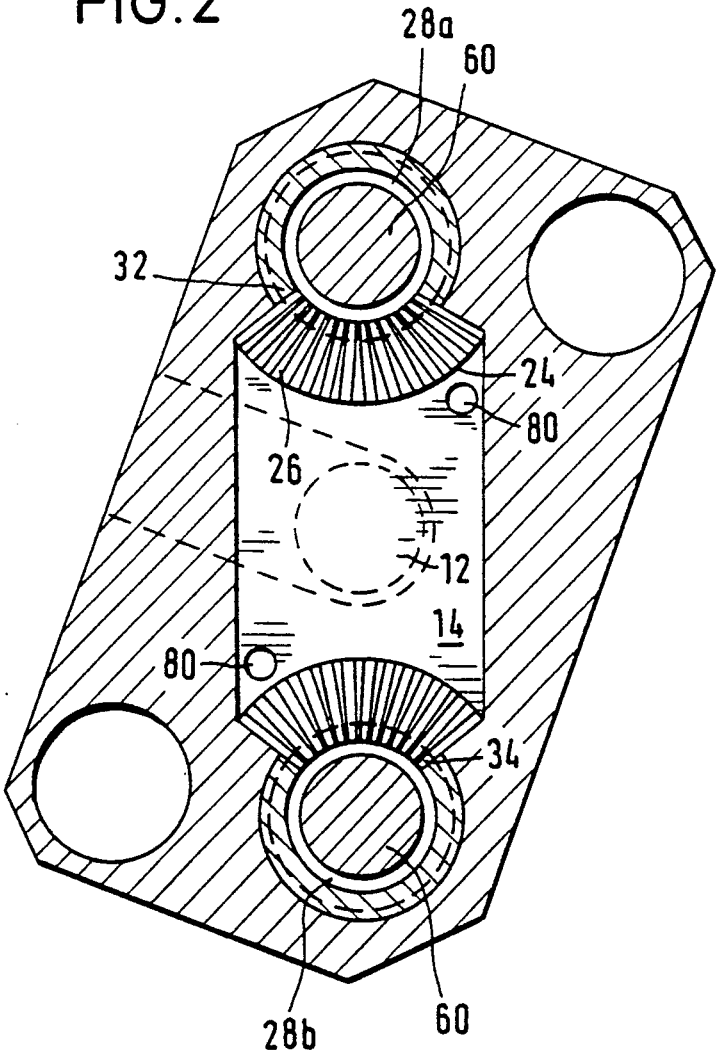
FIG. 2 is a cross-sectional view of the gun in FIG. 1, with the section made in the region of the combustion chamber.

The fluid propellant gun according to FIG. 1 includes a breech ring 10 having an approximately rectangular cross section as shown in FIG. 2. Breech ring 10 has a circular bore 12 in its center. Approximately in the middle of the longitudinal extent of bore 12, a combustion chamber 14 is provided which has a larger cross section than bore 12. In a front portion 12*a* of bore 12 (to the left of combustion chamber 14 in FIG. 1), bore 12 is surrounded by a tube 16 which serves to accommodate a projectile 18.

Bore 12 has a rear portion 12*b* (to the right of combustion chamber 14 in FIG. 1) which has essentially the same cross section as front portion 12*a*. Immediately following combustion chamber 14, however, a transverse channel 20 extending perpendicularly to bore 12*b* (and perpendicularly to the plane of the drawing) opens into bore 12*b*. While the side of transverse channel 20 shown on the left in FIG. 1 has a height corresponding to the diameter of bore 12*b*, transverse channel 20 continues from there as a conically widening section 20*a* which is followed by a section 20*b* having a rectangular cross section, with a step 21 extending outwardly from there, again followed by a further section 20*c* having an unchanging cross section. In the region penetrated by transverse channel 20, bore 12*b* is made correspondingly wider.

A wedge-type breech 23 having a mushroom-type breechblock 22, as known, for example, in artillery guns, is seated in transverse channel 20. Mushroom-type breechblock 22 can be moved out of the region of bore 12*b* by pivoting it within transverse channel 20 after wedge-type breech 23 has been opened, thus freeing bore 12*b* so that a projectile 18 can be brought into tube 16.

The configuration of combustion chamber 14 is shown, in particular, in FIG. 2. Combustion chamber 14 essentially has a rectangular cross section obliquely oriented with respect to the rectangular cross section of breech ring 10. The narrow side faces of combustion chamber 14 are formed by regions configured as injector surfaces 24. With respect to bore 12, injector surfaces 24 are convex cylindrical sections and are provided with radially extending apertures 26, preferably, as shown in FIG. 2, of a design which conically widens toward the interior of the combustion chamber. Pump chambers 28*a* and 28*b* follow the respective regions of injector surfaces 24 which face away from combustion chamber 14, with the structural configuration and the components connected thereto being described in greater detail below in connection with the upper pump chamber 28*a* of FIG. 2. The configuration of the diagonally oppositely disposed pump chamber 28*b* and its associated components correspond to that of pump chamber 28*a*.

Pump chamber 28*a* extends as a cylindrical bore from the left end (in FIG. 1) of breech ring 10 to shortly before the rear wall region 10*a* of breech ring 10 and thus forms a type of blind bore. Starting at open end 30 on the left, pump chamber 28*a* accommodates a sleeve-shaped rotary slide 32 which extends to somewhat behind the region of injector surface 24. In this region, injector surface 24 and the associated circumferential section of pump chamber 28*a* are configured to be slightly conically tapered in the direction toward rear wall 10*a* of breech ring 10. As a whole there results a cone frustum whose diameter decreases toward wall 10*a*. The associated circumferential section of rotary slide 32 is conically tapered correspondingly toward rear wall 10*a*, while its inner surface 32*a* is given the opposite conicity in this region, i.e. the bore in rotary slide 32 becomes wider toward wall 10*a*.

Moreover, the portion of rotary slide 32 in contact with injector surface 24 is provided with radially extending passage bores 34, while the regions facing injector surface 24 have approximately the same diameter as the regions in apertures 26 facing rotary slide 32 in injector surface 24.

The conically configured region of rotary slide 32 is followed, in the direction toward the open end 30 of pump chamber 28*a*, by a short cylindrical section 36 which then continues as a cylindrical section 38 having the same inner diameter (relative to the central axis of pump chamber 28*a*) but a smaller outer diameter.

A cylindrical muff 40 is seated in the area between the circumferential outer face of cylindrical section 38 and the wall of pump chamber 28*a* and this muff extends to shortly before a step 42 in rotary slide 32, thus forming a chamber 44. This chamber 44 accommodates a spring bearing including a conventional axial roller bearing 46 and an annular spring 48 disposed in front of the roller bearing when seen in the direction toward rear wall 10*a* of breech ring 10. This annular spring 48 presses against step 42 of rotary slide 32 and axial roller bearing permits low friction rotary movement of slide 32.

A first cylindrical section 52 of pump chamber 28*a* extends from a front wall 50 of ring 10 and is followed by a second cylindrical section 54 having a larger diameter and extending into a region of a frontal face 56 of rotary slide 32, with a small outward step 57 being provided in pump chamber 28*a* at frontal face 56.

As can be seen in FIG. 1, the transition region between cylindrical sections 52 and 54 simultaneously forms an abutment surface 58 for a pump piston 60 guided in pump chamber 28*a*. At this end (on the right in FIG. 1), pump piston 60 has a cylindrical section 60*a* whose diameter corresponds to the diameter of pump chamber 28*a* in this region. In the direction toward the opposite end 60*b* of pump piston 60, section 60*a* is followed by a conically tapered section 60*c* which, shortly before reaching frontal face 56 of rotary slide 32, changes into a cylindrical section 60*d* until it reaches end 60*b*.

In this way, if the parts are positioned as shown in the upper portion of FIG. 1, an annular cavity 62 is formed between cylindrical section 54 of pump chamber 28*a* and conical section 60*c* of pump piston 60 and between the conical section 32*a* of rotary slide 32 and the cylindrical section 60*d* of pump piston 60, respectively, with a transition region being formed shortly before frontal face 56 of rotary slide 32. Annular cavity 62 serves as a chamber to accommodate a propellant which can be introduced through a valve 64 disposed in breech ring 10 through an opening 65 disposed in rotary slide 32.

In the cylindrical section 60*d* of pump piston 60, in the region of cylindrical sections 36, 38 of rotary slide 32, there is provided a curved groove 66 in which is guided a curve roller 68 disposed on rotary slide 32. The configuration of curved groove 66 will be described in greater detail below.

Additionally, at the input end 30 of pump chamber 28*a*, there is provided an unlatching cylinder 70 which is disposed in a housing and is movable perpendicularly to pump piston 60. At its free end, unlatching cylinder 70 has a curve roller 72 which engages into a corresponding axial groove 74 on the surface of pump piston 60. Unlatching cylinder 70 and its associated housing are fastened to breech ring 10 and muff 40, respectively.

At its end 60*b*, pump piston 60 has an abutment disc 61*a* which is provided with a central opening through which a pull rod 76 extends coaxially with pump piston 60. At its end, pull rod 76 is provided with its own abutment disc 61*b* so that the path of movement of pump piston 60 is limited in the direction opposite to arrow A by way of pull rod 76 which, however, is inactive during the pumping and injection process. Pull rod 76 may, for example, be a toothed rod. It is driven by a drive 78.

Cylindrical section 52 at front wall 50 of pump chamber 28*a* is in communication with combustion chamber 14 by way of a connecting conduit 80.

All components are preferably sealed against one another in a gas tight manner by means of suitable seals as shown at various locations in the drawing.

The device operates as follows. A projectile 18 is positioned in tube 16, preferably by pushing it in through bore 12*b*, with mushroom-type breechblock 22 folded away, and through combustion chamber 14 (FIG. 1). The breechblock is then pushed back into the path of bore 12*b* and forms a secure seal for the combustion chamber 14 between same and the projectile 18. The shot is initiated by igniting a priming charge. The priming charge may be, for example, a pyrotechnic priming charge 19 fastened to projectile 18. The pressure released by the igniting charge moves through conduit 80 into cylindrical section 52 which then acts as a pressure chamber. The sudden increase in pressure charges cylindrical section 60*a* of pump piston 60 with pressure and pushes it away from abutment face 58.

Before firing of a priming charge, the pump chamber itself is closed tightly. The frustoconical section 33 of rotary slide 32 then securely covers injector surface 24 in that the individual components are associated such that the passage openings 34 in rotary slide 32 and apertures 26 in injector surface 24 are not congruent. The force of annular spring 48 presses rotary slide 32 with great strength onto injector surface 24 which is likewise given a curved approach slope (see FIG. 2) and onto the associated section of pump chamber 28*a*.

Due to the sudden build-up of pressure in pressure chamber 52, pump piston 60 is initially removed a small amount in the axial direction from abutment face 58. This is sufficient, due to the simultaneous increase in hydraulic pressure of the fluid propellant in chamber 62, to likewise cause displacement of rotary slide 32 by the same small amount in the same axial direction against the force of annular spring 48, so that the slide is released from its pressure seat against, in particular, injector surface 24. Immediately thereafter, slide 32 is also able to rotate which takes place by wa of curved groove 66 in the cylindrical section 60*d* of pump piston 60 and the curve roller 68 guided therein on the inner face of rotary slide 32. With the further advance of pump piston 60, a positive rotation of slide 32 is produced via action of curve roller 68 in curved groove 66 and slide 32 is thus displaced into a position in which passage openings 34 are congruent with the corresponding apertures 26 in injector surface 24 so that the propellant in annular pump chamber 28*a* can be injected into combustion chamber 14. Pump piston 60 itself is held against rotation by way of axial groove 74 and the associated curve roller 72.

While the axial displacement of rotary slide 32 is limited by spring 48 and roller bearing 46, pump piston 60 continues to be accelerated in the axial direction since the pressure generated in combustion chamber 14 by the combustion of the propellant continues to be conducted through conduit 80 into the rear portion of pump chamber 28*a* behind section 60*a*. Due to the corresponding relative displacement and the inventive configuration of rotary slide 32 with its internal cone 32*a* and pump piston 60 with its corresponding external cone 60*c*, the annular cavity 62 of pump chamber 28*a* becomes smaller and smaller and correspondingly more and more propellant is expelled via injector surface 24. Toward the end of the stroke of the pump piston, the configuration of curved groove 66 assures that rotary slide 32 is rotationally returned to its starting position and the cross sections of apertures 26 are closed in a controlled manner in dependence on the piston stroke, with the pump piston 60 being braked in the desired manner. The return of the piston still takes place under the influence of axial pressure on rotary slide 32. As soon as cylindrical section 60*a* of pump piston 60 abuts at the frontal face 56 of rotary slide 32, the gas pressure acting on pump piston 60, once combustion has ended, is transferred to slide 32. When the gas pressure has dropped, annular spring 48 pushes rotary slide 32 back onto injector surface 24 and takes care that there is an absolutely tight seal.

Then, pump chamber 28*a* can be filled again. This is done via valve 64, with pump piston 60 being returned simultaneously. Since, however, rotary slide 32 must now not be displaced any more, in order to assure a tight seal with respect to injector surface 24, pump piston 60 must be able to rotate. This is accomplished by unlatching cylinder 70, with the aid of which curve roller 72 is pushed out of axial groove 74 in cylindrical section 60*d* of pump piston 60. Since rotary slide 32 is now pressed into the sealing cone, it is no longer able to rotate.

The filling process is continued until the cylindrical section 60*a* of the pump piston abuts at abutment face 58 and thus has regained its starting position. However, the stroke of pump piston 60 may also be limited by pull rod 76 and its abutment disc 61*b* in that its fixed drive 78 pushes it against abutment disc 61*a*. Pull rod 76 simultaneously serves to advance pump piston 60, for example, when firing ceases and curve roller 72 has been removed with the aid of unlatching cylinder 70 (a described above) similarly to the procedure for firing.

Since rotary slide 32 is now not axially displaced and rotated, a tight seal of apertures 26 in injector surface 24 is assured and the propellant can be removed via valve 64 or, more precisely, via opening 65 disposed upstream of it. Instead of the pull rod arrangement any other displacement mechanism can of course also be employed.

Pump chamber 28*b* is configured in the same way as described above for pump chamber 28*a*. For better clarity, the associated pump pistons 60 and rotary slides 32 in pump chambers 28*a* and 28*b*, respectively, are shown in different positions in FIG. 1. The components associated with pump chamber 28*a* are shown in the position immediately before firing of the priming charge, i.e. after pump chamber 28*a* has been filled with propellant. In the lower portion of FIG. 1, pump piston 60 in pump chamber 28*b* can be seen in an advanced position where the conical section 60*c* following cylindrical section 60*a* rests against the corresponding conical inner wall 32*a* of rotary slide 32, with cylindrical section 60*a* simultaneously abutting against frontal face 56.

Figure 3:
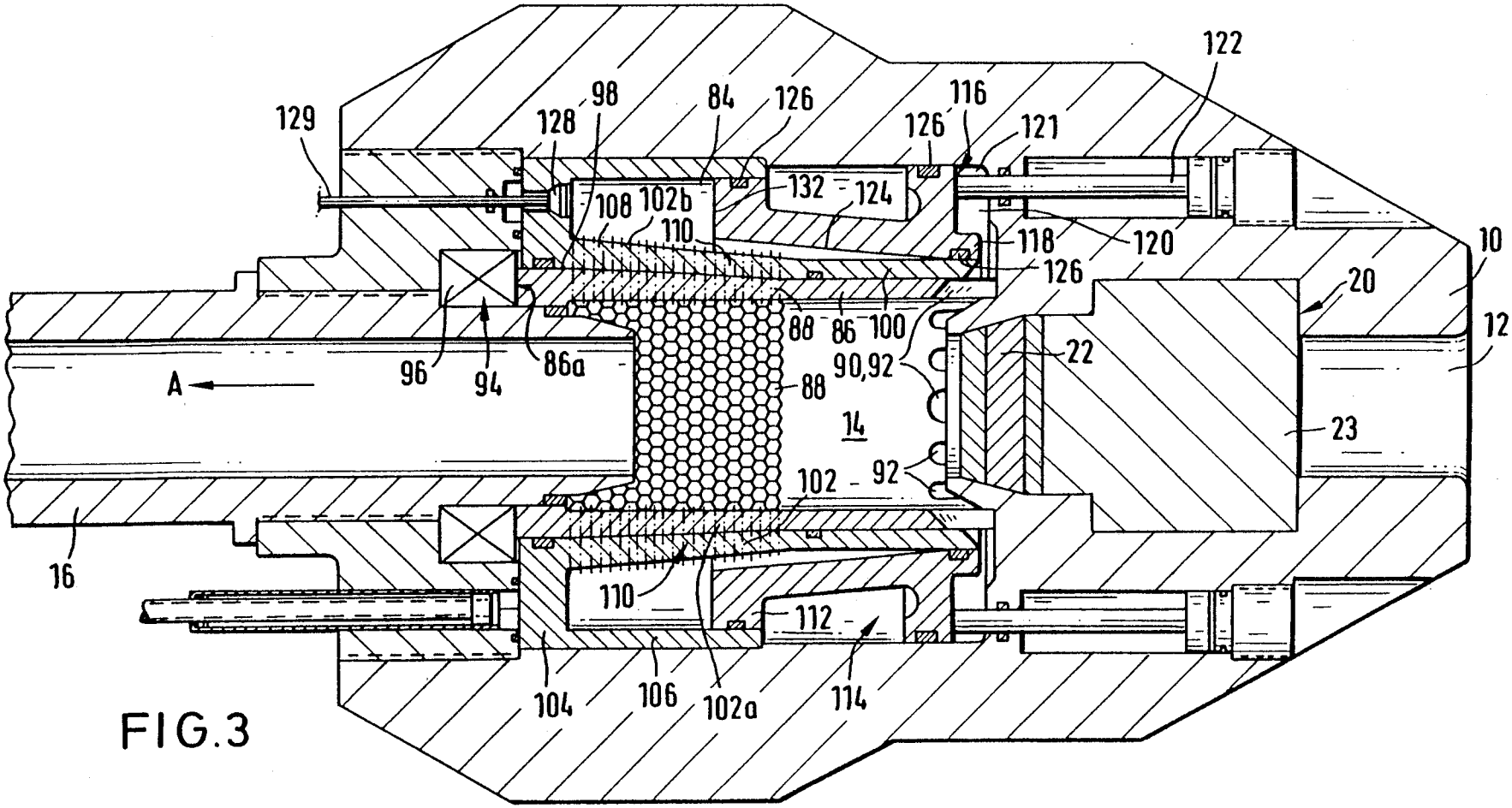
FIG. 3 is a longitudinal sectional view of another embodiment of a fluid propellant gun according to the invention which has an annular pump chamber.

The embodiment shown in FIG. 3 relates to a fluid propellant gun having an annular pump chamber 84. The configuration of breech ring 10 and that of tube 16 and its associated bore 12 with transverse channel 20 and mushroom-type breechblock 22 again substantially correspond to FIGS. 1 and 2.

In contrast to the above-described embodiment, however, the injector surface does not constitute a section of the wall of combustion chamber 14. Rather, combustion chamber 14, which in the embodiment according to FIG. 3 has a circular cross section and thus as a whole a cylindrical shape, is delimited circumferentially on its cylindrical surface by a control slide 86. Control slide 86 has the shape of a cylindrical sleeve, and at least in the region of the front section of its cylindrical face (in FIG. 3, the left-hand portion), a plurality of spaced passage openings 88 are uniformly distributed over the circumference and pass in radial orientation through control slide 86.

At its end at the left-hand side in FIG. 3, control slide 86 is guided so as to slide in corresponding contact faces in breech ring 10 and on tube 16. At its end facing mushroom-type breechblock 22, the cylindrical control slide 86 is provided with a plurality of spaced recesses 90 which are open toward the free end. These recesses form a passage region for gas channels 92 whose structure and function will be described in greater detail below.

At the end opposite recesses 90, frontal face 86*a* of control slide 86 is followed by a circumferential annular recess 94 in which there is disposed a control device, for example an annular spring 96 disposed on an axial roller bearing so as to act on frontal face 86*a*. As can be seen in FIG. 3, the interior surface of control slide 86 is completely cylindrical over its entire longitudinal extent, while, in its frontal section (i.e. the section provided with passage openings 88), the outer surface 98 is provided with a slope to form a cone which ascends in the direction toward recess 94 so that, as a whole, there results an approximately frustoconical shape.

A sleeve-shaped component 100 is seated on the exterior of control slide 86 and ends at a short distance before the corresponding ends of control slide 86. This component 100 extends on control slide 86 from the free rear end (in the region of recesses 90) parallel to the associated section of control slide 86 until shortly before the region provided with passage openings 88. There a section 102 follows whose inner face 102*a* facing control slide 86 has the same slope as the outer face 98 of control slide 86. The outer face 102*b* of section 102, however, has a steeper slope in the direction toward its associated free end so that section 102, at its free end, is made of thicker material than the transition region toward the rear cylindrical section. At its free end facing recess 94, section 102 changes to a projection 104 which projects outwardly at a right angle and which is followed in the direction toward mushroom-type breechblock 22, again at a right angle, by a cylindrical section 106. The outer face of cylindrical section 106 is here essentially parallel to the inner face of control slide 86. Component 100 is held stationary in breech ring 10 by means of cylindrical section 106.

The frustoconical section 102 of component 100 is provided, analogously to control slide 86, with a plurality of radially arranged apertures 108 which, in this embodiment, also form part of the injector surface.

Moreover, in the region between component 100 and the circumferential section of breech ring 10, there is provided an annular pump piston 112 which in its middle has an annular groove 114 on its outer face. In its section facing component 100, a rear frontal face 116 of piston 112 is provided with an annular projection 118 extending in the direction toward mushroom-type breechblock 22. Projection 118 as well as inevitably also frontal face 116 are spaced from the corresponding wall face 120 of breech ring 10, thus forming a chamber 121. Movement beyond this point toward wall face 120 is prevented by the arrangement of a piston 122 extending in a corresponding recess in breech ring 10, with frontal face 116 being brought into contact with the frontal face of piston 122. Piston 122 will be described in greater detail below.

The inner face of annular pump piston 112 is again slightly conical, i.e. after an initially purely cylindrical section, inner face 124 extends parallel to face 102*b* of section 102. In the region of projection 118 there is additionally provided an annular seal 126 against component 100.

At its frontal end, the outer face of pump piston 112 is guided in cylindrical section 106 of component 100, with here again an annular seal 126*a* being provided. Another similar annular seal 126*b* is provided in the region in which the outer face at the opposite end of pump piston 112 is guided in breech ring 10.

Projection 104 is axially penetrated by a valve arrangement 128 through which propellant can be fed into pump chamber 84. As shown in FIG. 3, pump chamber 84 is then delimited by the inner face 124 of pump piston 112, frontal face 132 of pump piston 112 and the respectively inwardly oriented corresponding faces of component 100. The size of pump chamber 84 may be set, inter alia, by the position of pump piston 112, for which purpose piston 122 is pressed forward to a greater or lesser extent.

In the embodiment shown in FIG. 3 it is particularly important that a connection is established from combustion chamber 14 to behind control slide 86 and frontal face 116 of pump piston 112, respectively. In the illustrated embodiment, this is done by radially extending gas channel 90 leading into chamber 121 to thus permit the introduction of pressure.

For the illustrated embodiments as a whole it is particularly advantageous that the pump chambers 28*a*, 28*b* of FIGS. 1 and 2 and pump chamber 84 of FIG. 3 are disposed in front of the breech region (when seen in the direction of projectile ejection), since this provides for optimum injection into and combustion of the propellant in combustion chamber 14.

The embodiment illustrated in FIG. 3 operates as follows. A priming charge is applied by one of the previously described alternative possibilities. The gas pressure is conducted through gas channels 90 and the associated recesses in the individual components, to behind the rear frontal face of control slide 86 and the rear frontal face 116 of the pump piston and into chamber 121. Once a certain pressure is reached, and this occurs within milliseconds or less because of the very rapid pressure build-up, control slide 86 is pressed toward the left (arrow A) against the force of spring 96. Due to the conicity of the corresponding faces of control slide 86 and component 100, the displaceable control slide 86 is then easily released from component 100 or, more precisely, from the corresponding injector surface 110. While, in the starting position, components 86, 100 are aligned with respect to one another such that the openings of the one lie against the closed regions of the other, the displacement moves control slide 86 into a position in which its passage openings 88 are flush with apertures 108 in component 100 and thus permit propellant to pass through and to be injected into combustion chamber 14. At the same time, pump piston 112 is advanced in the direction of arrow A and continuously reduces the size of pump chamber 84. Due to the sloped annular inner face 124 of pump piston 112, the latter is pushed by an oblique/parallel displacement onto the corresponding face 102*b* of injector section 110. This gradually constricts influx to the apertures 108 in injector surface 110 so that pump piston 112 is braked again. After a further increase of the gas pressure due to the injected main charge, the pressure drops again with the result that, due to the action of spring 96, control slide 86 is returned to its original position. Passage openings 86 and apertures 108 are again sealed against one another.

For the subsequent renewed filling of pump chamber 84, propellant is supplied through valve arrangement 128 and a conduit 129 and, with increasing fill level, pump piston 112 is returned to its starting position defined by an abutment for piston 122.

Conversely, piston 122 can also be utilized to empty pump chamber 84, for which purpose it is advanced in the direction of arrow A and the propellant is discharged to the outside through valve arrangement 128.

FIG. 3 shows that a plurality of pistons 122, for example four pistons (two of them are shown), are arranged in a spaced relationship to as to be able to exert uniform pressure against the frontal face 116 of pump piston 112 and to hold it uniformly.

While in the two disclosed embodiments, the injector surfaces 24, 110 were defined as those surfaces or regions which form sections that are part of the housing, the sections of slides 32, 86 which are provided with the passage openings 34, 88 do of course also constitute "injector surfaces", particularly since the various passage openings may be identical in the various components with respect to size and also with respect to number and mutual distribution. However, it is also possible to provide slides 32, 86 and the fixed injector surface 24, 110 with passage bores of different sizes and distribution. A corresponding optimization depends, for example, on the size of the projectile to Although it is not expressly described for each component, the drawing shows that the individual components are sealed against one another by means of numerous seals so as to assure, in particular, gas tight connections between the individual components. The twin pump chamber system according to FIGS. 1 and 2, however, has only two movable seals per chamber (in the region of cylindrical section 60*a* and around the opposite cylindrical end section 60*d*) and a quasi-static seal at the sleeve-shaped rotary slide 32, which increases operational reliability as a whole. These relatively few seals, however, due to their structural association with the components as provided by the present invention, are sufficient to realize the desired gas tightness.

It will be understood that the above description of the present invention is susceptible to various modifications, changes and adaptations, and the same are intended to be comprehended within the meaning and range of equivalents of the appended claims.

What is claimed is:

1. In an injection device for fluid propellants for a fluid propellant gun having a combustion chamber, the device including at least one pump chamber for receiving a propellant; a pump piston movable in the pump chamber; an injector surface arranged at least partially around the combustion chamber approximately radially to the direction of ejection of a projectile from the gun, the injector surface having apertures through which propellant can flow between the pump chamber and the combustion chamber; and means for providing a measured opening and closing of the apertures in the injector surface; the improvement wherein:

said means for providing a measured opening and closing of said apertures in said injector surface comprises a slide which is relatively movable with respect to said injector surface, and which is provided with passage openings for controllably communicating with the apertures in said injector surface; and further including means for generating a pressure for displacing said slide.

2. Device as defined in claim 1, wherein said slide is movable in a direction parallel to said injector surface.

3. Device as defined in claim 1, wherein said pump piston is displaceable in said pump chamber with respect to said slide and said injector surface, and said pump piston has a surface which is shaped to seal or release the passage openings in said slide and the apertures in said injector surface when said pump piston is displaced in said pump chamber.

4. Device as defined in claim 1, wherein said injector surface forms at least part of a wall of said combustion chamber and said slide is arranged to be slidable on the exterior of said injector surface.

5. Device as defined in one of claim 1, wherein said slide forms at least part of a wall of said combustion chamber and is mounted to be slidable with respect to said injector surface.

6. Device as defined in claim 1, wherein said injector surface, said slide and said pump piston are configured as rotationally symmetrical components.

7. Device as defined in claim 1, and further including a propellant conduit communicating with said pump chamber, and a valve controlling the opening and closing of said propellant conduit.

8. Device as defined in claim 1, wherein said pump chamber is formed by an annular gap between said slide and said pump piston.

9. Device as defined in claim 1, wherein said pump chamber is formed by a gap between said injector surface and said pump piston.

10. Device as defined in claim 1 forming a combination with said fluid propellant gun, said gun including a removable breechblock, wherein, in the direction of injection of a projectile from said gun, said combustion chamber is delimited in a gas tight manner on one side by a projectile and on an opposite side by said removable breechblock.

11. Device as claimed in claim 1, wherein said means for generating a pressure for displacing said slide includes a separate priming charge.

12. Devices as claimed in claim 1, wherein said means for generating a pressure for displacing said slide includes means for using a propellant for generating such pressure.

13. Device as claimed in claim 1, wherein said means for generating a pressure for displacing said slide includes means for using said pump piston for generating such pressure.

14. Device as defined in claim 1, wherein said slide, said injector surface and said pump piston are provided with sloped faces on their longitudinal extent at least on partial sections of their corresponding surfaces.

15. Device as defined in claim 14, wherein said sloped faces are disposed in a region of said passage openings of said slide and of the apertures of said injector surface.

16. Device as defined in claim 1, and further including a compressed biasing device against which said slide is mounted in the direction of its movement.

17. Device as defined in claim 16, wherein said compressed biasing device comprises a spring bearing.

18. Device as defined in claim 1, and further including a compressed biasing device against which said pump piston is mounted in the direction of its movement.

19. Device as defined in claim 18, wherein said compressed biasing device comprises a spring bearing.

20. Device as defined in claim 1, and further including means for limiting the path of movement of said pump piston with respect to said slide and said injector surface.

21. Device as defined in claim 20, wherein said means for limiting the path of movement of said pump piston comprises one of an abutment which is adjustable along said path of movement or a guide piston.

22. Device as defined in claim 1, wherein said pump piston has one end provided with a frontal face and further including a pressure chamber provided at said end of said pump piston which is delimited at least in part by said frontal face.

23. Device as define din claim 22, wherein said means for generating includes a connecting conduit connecting said pressure chamber and said combustion chamber.

24. Device as defined in claim 22, wherein said slide has an end with a frontal face which additionally delimits said pressure chamber.

25. Device as defined in claim 1, wherein said pump piston has a curved groove disposed on its surface and said slide has a curve roller disposed on its surface for engagement with said curved groove, and said pump piston and said slide are rotatably guided with respect to one another by way of said curved groove and said curve rollers.

26. Device as define din claim 25, wherein said curved groove is configured to provide for an axial back and forth movement of said slide.

27. Device as defined in claim 26, and further including means for securing said pump piston against rotation.

28. Device as defined in claim 27, wherein said means for securing comprises an axial groove disposed in the surface of said pump piston and a curve roller guided therein.

29. Device as defined in claim 28, wherein said curve roller disposed in said axial groove is mounted to as to be removable from said axial groove.

30. In a fluid propellant gun having a combustion chamber and a fluid propellant injection device, for fluid propellants with said device including at least one pump chamber for receiving a propellant, a pump piston movable in the pump chamber, an injector surface arranged at least partially around said combustion chamber approximately radially to the direction of ejection of a projectile from the gun and with said injector surface having apertures through which propellant can flow between said pump chamber and said combustion chamber, and means for providing a measured opening and closing of said apertures in said injector surface; the improvement wherein:

said means for providing a measured opening and closing of said apertures in said injector surface comprises a slide which is relatively movable with respect to said injector surface, and which is provided with passage openings for controllably communicating with the apertures in said injector surface; and further including means for generating a pressure for displacing said slide.

31. A third propellant gun as defined in claim 30, wherein said injection device is arranged to be rotationally symmetrical, and further including a tube for carrying a projectile and wherein said injection device is rotationally symmetrical around said combustion chamber.

32. A fluid propellant gun as defined in claim 30, wherein said injection device includes two pump chambers and associated components disposed at opposite sides of said combustion chamber.

33. A fluid propellant gun as defined in claim 32, wherein said gun has a breech ring with a generally rectangular cross section in which said injection device is disposed and wherein said pump chambers each have a central longitudinal axis which is disposed on an imaginary diagonal line of said rectangular cross section drawn through the center of said combustion chamber.

* * * * *